US011098585B2

(12) United States Patent
Mu et al.

(10) Patent No.: US 11,098,585 B2
(45) Date of Patent: Aug. 24, 2021

(54) HYDRAULIC END DIE OF TUNNEL SECONDARY LINING TROLLEY AND CONSTRUCTION METHOD THEREFOR

(71) Applicants: NO. 3 ENGINEERING COMPANY OF CHINA RAILWAY NO. 8 ENGINEERING GROUP CO., LTD., Guizhou (CN); CHINA RAILWAY NO. 8 ENGINEERING GROUP CO., LTD., Sichuan (CN)

(72) Inventors: Jianlin Mu, Guizhou (CN); Luwei Feng, Guizhou (CN); Bochuan Zeng, Guizhou (CN); Jian Hu, Guizhou (CN); Lianfang Li, Guizhou (CN); Deli Feng, Guizhou (CN); Yong Lan, Guizhou (CN); Zifa Zhou, Guizhou (CN); Hongbo Song, Guizhou (CN); Xiangjun Zeng, Guizhou (CN); Shangbang Wang, Guizhou (CN)

(73) Assignees: NO. 3 ENGINEERING COMPANY OF CHINA RAILWAY NO 8 ENGINEERING GROUP CO., LTD., Guizhou (CN); CHINA RAILWAY NO. 8 ENGINEERING GROUP CO., LTD., Sichuan (CN)

( * ) Notice: Subject to any disclaimer, the term of this patent is extended or adjusted under 35 U.S.C. 154(b) by 0 days.

(21) Appl. No.: 16/982,038

(22) PCT Filed: Mar. 21, 2019

(86) PCT No.: PCT/CN2019/079038
§ 371 (c)(1),
(2) Date: Sep. 17, 2020

(87) PCT Pub. No.: WO2019/184791
PCT Pub. Date: Oct. 3, 2019

(65) Prior Publication Data

US 2021/0108515 A1 Apr. 15, 2021

(30) Foreign Application Priority Data

Mar. 28, 2018 (CN) ..... 201810264059.X

(51) Int. Cl.
*E21D 11/10* (2006.01)
*E21D 11/38* (2006.01)

(52) U.S. Cl.
CPC ..... *E21D 11/102* (2013.01); *E21D 11/381* (2013.01); *E21D 11/383* (2013.01)

(58) Field of Classification Search
CPC ..... E21D 11/10; E21D 11/102; E21D 11/385
See application file for complete search history.

(56) References Cited

U.S. PATENT DOCUMENTS 1,802,815 A * 4/1931 Hilton ..... E21D 11/102 249/186

FOREIGN PATENT DOCUMENTS

CN 202900287 U 4/2013
CN 103114862 A 5/2013
(Continued)

*Primary Examiner* — Sunil Singh
(74) *Attorney, Agent, or Firm* — Novick, Kim & Lee, PLLC; Allen Xue

(57) ABSTRACT

A hydraulic end die of a tunnel secondary lining trolley, comprises a trolley side die-end die assembly (6) and a trolley top die-end die assembly (10). The trolley side die-end die assembly is fixed at an outer ring of a trolley side die assembly (2) by means of a trolley side die-end die fixing device (3); the trolley top die-end die assembly is fixed at an outer ring of a trolley top die assembly (11) by means of a trolley top die-end die fixing device (8); and the trolley side die-end die assembly and the trolley top die-end die assembly are connected to a hydraulic control system by means of a trolley side die-end die hydraulic telescopic device (4) and a trolley top die-end die hydraulic telescopic device (9) respectively. Further disclosed is a construction method for
(Continued)

a hydraulic end die of a tunnel secondary lining trolley. The hydraulic end die of the tunnel secondary lining trolley and the construction method therefor can conveniently and quickly mount and dismount the trolley end dies while accelerating the construction progress of tunnel secondary lining construction, thus reducing construction costs and improving labor productivity.

10 Claims, 5 Drawing Sheets

(56) References Cited

FOREIGN PATENT DOCUMENTS

| | | | | |
|---|---|---|---|---|
| CN | 105822324 | A | | 8/2016 |
| CN | 205977236 | U | * | 2/2017 |
| CN | 206419031 | U | | 8/2017 |
| CN | 108301847 | A | | 7/2018 |
| CN | 208010366 | U | | 10/2018 |
| JP | 2017002630 | A | | 1/2017 |
| KR | 101776091 | B1 | | 9/2017 |

* cited by examiner

HYDRAULIC END DIE OF TUNNEL SECONDARY LINING TROLLEY AND CONSTRUCTION METHOD THEREFOR

TECHNICAL FIELD

The present invention relates to a hydraulic end die of tunnel secondary lining trolley and a construction method therefor mainly used for placing and setting concrete for railway and highway tunnel secondary lining. Due to particular characteristics of tunnel construction, a trolley end die must be mounted and dismounted for each use, and the operation process cannot be guaranteed to be exactly the same each time, which has a great impact on later work such as tunnel defect elimination. The present invention can reduce procedures of mounting and dismounting the end die each time, save a lot of manpower and material resources, ensure position error accuracy of a circumferential medium-buried water stop within 5 mm, ensure that the water stop is not folded and damaged in construction process, and promote tunnel construction quality to a new level.

BACKGROUND

With continuous growth of scale of infrastructure construction in China, construction of new highways and railways increases day by day. Trolley end dies for secondary linings of new railway and highway tunnels were mostly assembled with single plank and single batten in the past, and such method is featured by multiple construction procedures, tedious operations, low construction efficiency and high construction cost, so it is difficult to ensure quality of secondary lining ends, seriously affecting the overall construction period. Meanwhile, the mounting technology of secondary lining circumferential medium-buried water stops cannot reach the design requirements, and sizes and positions thereof cannot be determined accurately, even most of the water stops are damaged.

SUMMARY

To overcome the above disadvantages of the prior art, the present invention provides a hydraulic end die of a tunnel secondary lining trolley and a construction method therefor. The hydraulic end die features simple structure, convenient and fast operation, and safe use, thus realizing the whole cycle process from trolley travel to secondary lining concrete placing without dismounting, greatly reducing labor intensity of workers, and ensuring the position of the circumferential medium-buried water stop and that the water stop is not folded or damaged during construction.

The technical solution used by the present invention for solving the technical problems is: a hydraulic end die of a tunnel secondary lining trolley, comprises a trolley side die-end die assembly and a trolley top die-end die assembly; wherein the trolley side die-end die assembly is fixed at an outer ring of a trolley side die assembly by means of a trolley side die-end die fixing device; the trolley top die-end die assembly is fixed at an outer ring of a trolley top die assembly by means of a trolley top die-end die fixing device; and the trolley side die-end die assembly and the trolley top die-end die assembly are connected with a hydraulic control system by means of a trolley side die-end die hydraulic telescopic device and a trolley top die-end die hydraulic telescopic device.

The present invention also provides a construction method for a hydraulic end die of a tunnel secondary lining trolley, which comprises the following steps: mounting a trolley top die-end die assembly and a side die-end die assembly, respectively; turning down a trolley hydraulic end die upper structure by means of a trolley hydraulic end die upper-lower structure connection hinge, fixing a trolley hydraulic end die lower structure on a trolley top die or side die assembly by means of a top die or side die-end die fixing device, and turning up the trolley hydraulic end die upper structure for fixing to mount circumferential medium-buried water stops; using a hydraulic control system to control trolley side die and top die-end die hydraulic telescopic devices to drive the trolley side die and top die-end die assemblies to stretch out and draw back to use positions under the guidance of the end die fixing device; connecting the trolley top die-end die assembly and the side die-end die assembly into a whole by means of a trolley end die connection device, and then placing concrete after reinforcing the whole body by means of a reinforcement portion; and dismounting the reinforcement portion, then dismounting the trolley end die connection device so that the trolley top die-end die assembly is separated from the side die-end die assembly, and sequentially dismounting the trolley top die-end die assembly and the side die-end die assembly.

Compared with the prior art, the present invention has the following positive effects: updating the key technical problem in tunnel secondary lining trolley construction, being capable of conveniently and quickly mounting and dismounting the trolley end die while accelerating the construction progress of tunnel secondary lining construction, thus reducing construction costs and improving labor productivity.

BRIEF DESCRIPTION OF THE DRAWINGS

The present invention will be described in combination with embodiments and accompanying drawings, in which.

DETAILED DESCRIPTION

Figure 1:
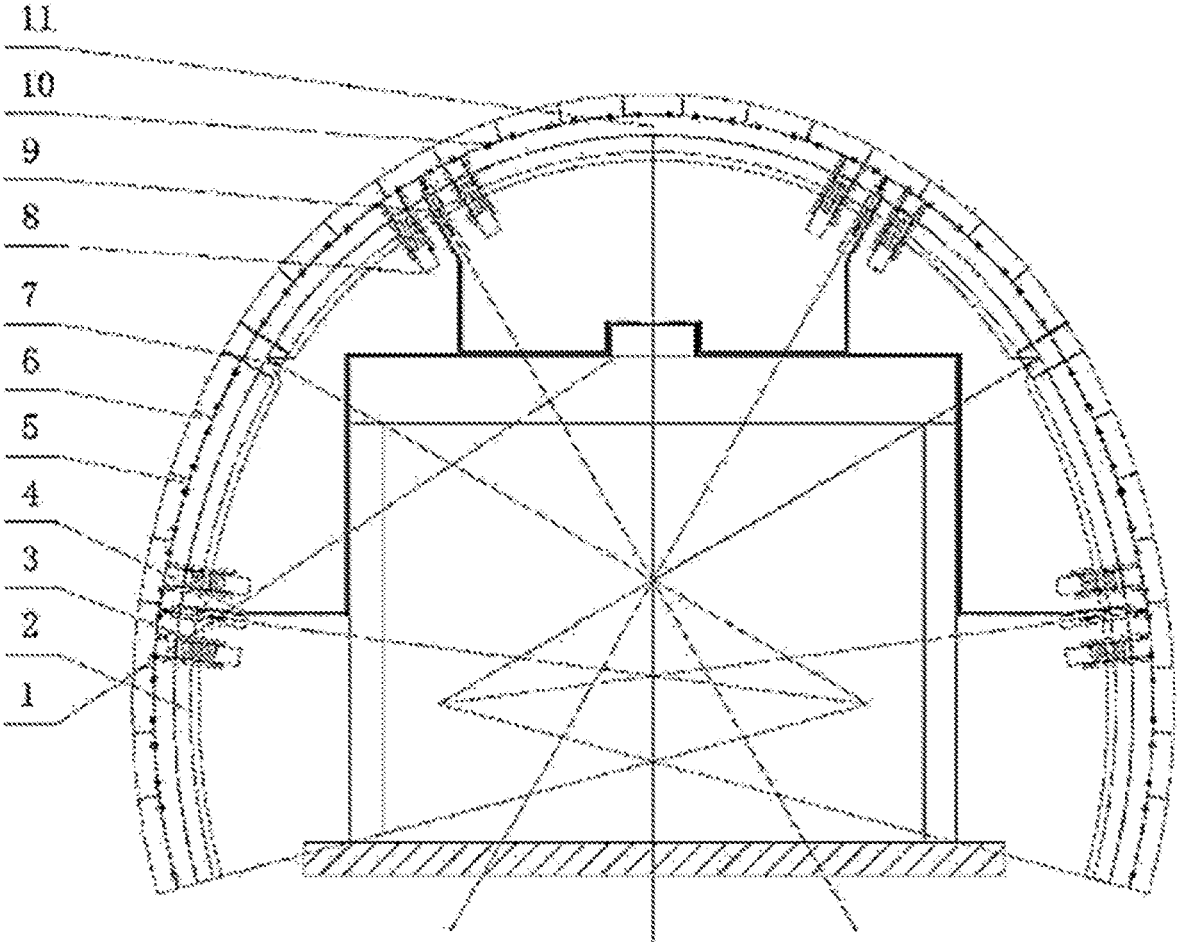
FIG. 1 illustrates a structure diagram of a hydraulic end die.

A hydraulic end die of a tunnel secondary lining trolley, as shown in FIG. 1, comprises: a hydraulic control system 1, a trolley side die assembly 2, a trolley side die-end die fixing device (i.e., guide slot) 3, a trolley side die-end die hydraulic telescopic device 4, circumferential medium-buried water stops 5, a trolley side die-end die assembly 6, a trolley end die connection device 7, a trolley top die-end die fixing device (i.e., guide slot) 8, a trolley top die-end die hydraulic telescopic device 9, a trolley top die-end die assembly 10, and a trolley top die assembly 11.

Side Die-End Die Portion:

The trolley side die assembly 2 is fixed with the trolley side die-end die assembly 6 by means of the trolley side die-end die fixing device (i.e., guide slot), and the trolley side die-end die hydraulic telescopic device 4 is connected with the trolley side die-end die assembly 6. The hydraulic control system 1 controls the trolley side die-end die hydraulic telescopic device 4, and the circumferential medium-buried water stop 5 is fixed by means of the trolley side die-end die assembly 6.

Figure 2:
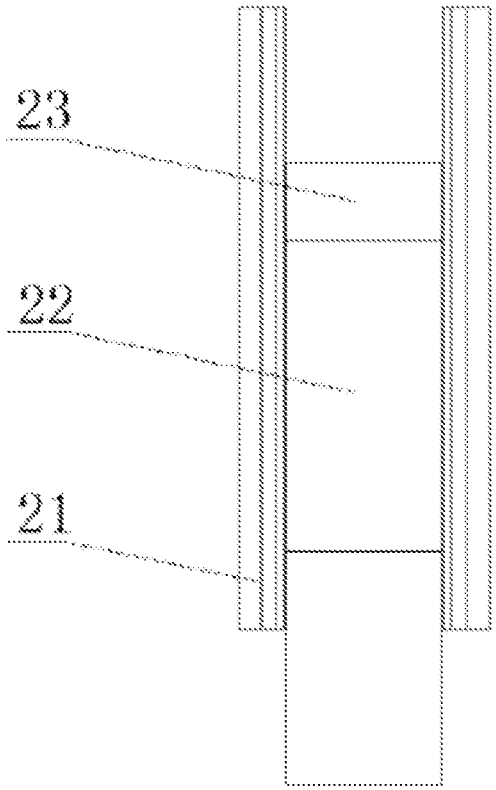
FIG. 2 illustrates a structure diagram of a trolley side (top) die-end die fixing device (i.e., guide slot)

The trolley side die-end die fixing device (i.e., guide slot) 3, structured as shown in FIG. 2, comprises an outer slideway 21, an inner shaft limit baffle 22, and an inner shaft 23. The outer slideway 21 is fixed with the trolley side die-end die assembly 6, the inner shaft is fixed with the trolley side die assembly 2, and the inner shaft limit baffle 22 is arranged on the outer slideway 21 to limit and fix the inner shaft 23. The trolley side die-end die assembly 6 is fixed with the outer slideway 21 of the trolley side die-end die fixing device (i.e., guide slot) 3, and the trolley side die assembly 2 is fixed with the inner shaft 23 of the side die-end die fixing device (i.e., guide slot) 3; and the outer slideway portion of the side die-end die fixing device (i.e., guide slot) 3 is matched with the inner shaft portion with a fit clearance of 1 mm. At the same time, the trolley side die assembly 2 can be ensured not to be separated from the trolley side die-end die assembly 6.

Figure 3:
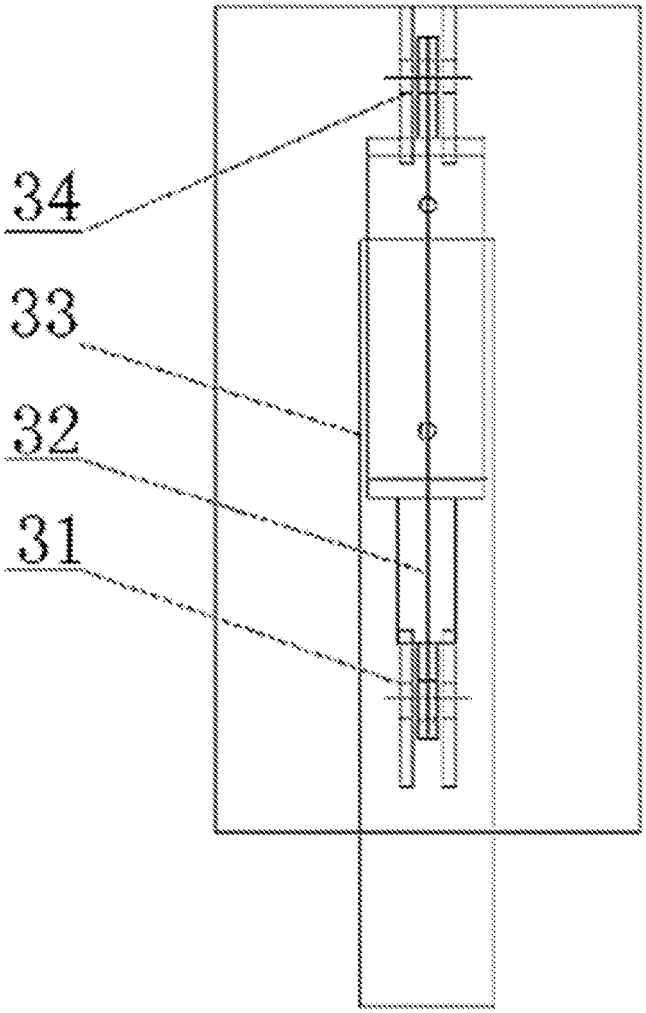
FIG. 3 illustrates a structure diagram of a trolley side (top) die-end die hydraulic telescopic device.

The trolley side die-end die hydraulic telescopic device 4, structured as shown in FIG. 3, comprises a telescopic cylinder trolley end fixing lug 31, a telescopic cylinder 32, a trolley end fixing plate 33, and a telescopic cylinder end die end fixing lug 34. The trolley end fixing plate 33 is fixed on the trolley side die assembly 2, and the telescopic cylinder trolley end fixing lug 31 is fixed with the trolley end fixing plate 33, the telescopic cylinder end die end fixing lug 34 is fixed with the trolley side die-end die assembly 6, and the telescopic cylinder trolley end fixing lug 31 is connected with the telescopic cylinder end die end fixing lug 34 by means of the telescopic cylinder 32. The telescopic cylinder 32 is controlled to make the trolley side die-end die assembly 6 reach a designated position.

The hydraulic control system 1 controls the trolley side die-end die hydraulic telescopic device 4 to drive the trolley side die-end die assembly 6 to stretch out and draw back to use positions, so that the trolley side die-end die assembly 6 can precisely stretch out and draw back with the hydraulic control system 1 as a force generation point, the trolley side die-end die hydraulic telescopic device 4 as a force transmission point, and the side die-end die fixing device (i.e., guide slot) 3 as a guide point to reach precision control requirements.

Figure 4:
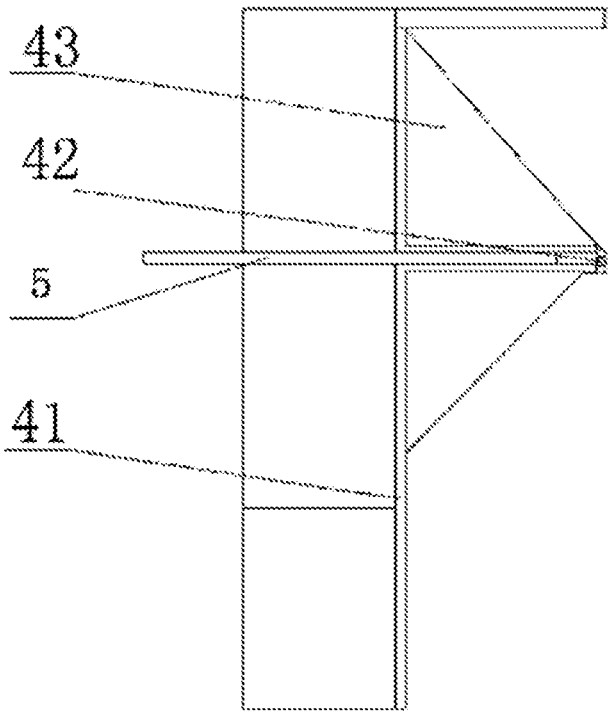
FIG. 4 illustrates a structure diagram of a trolley circumferential medium-buried water stop.

The circumferential medium-buried water stop 5, structured as shown in FIG. 4, comprises a trolley hydraulic end die lower structure 41, a trolley hydraulic end die upper-lower structure connection hinge 42, and a trolley hydraulic end die upper structure 43. The trolley hydraulic end die lower structure 41 is fixed on the trolley side die assembly 2 by means of the side die-end die fixing device (i.e., guide slot) 3, and the trolley hydraulic end die upper structure 43 is connected with the trolley hydraulic end die lower structure 41 by means of the trolley hydraulic end die upper-lower structure connection hinge 42. Before the circumferential medium-buried water stop 5 is mounted, the trolley hydraulic end die upper structure 43 is turned down by means of the trolley hydraulic end die upper-lower structure connection hinge 42, and then the trolley hydraulic end die upper structure 43 is turned up for fixing, thus ensuring the position of the water stop and keeping the water stop from being damaged easily.

Top Die-End Die Portion:

The trolley top die assembly 11 is fixed with the trolley top die-end die assembly 10 by means of a trolley top die-end die fixing device 8 (i.e., guide slot), and the trolley top die-end die hydraulic telescopic device 9 is connected with the trolley top die-end die assembly 10. The hydraulic control system 1 controls the trolley top die-end die hydraulic telescopic device 9, and the circumferential medium-buried water stop 5 is fixed by means of the trolley top die-end die assembly 10.

The trolley top die-end die fixing device (i.e., guide slot) 8, structured as shown in FIG. 2, comprises an outer slideway 21, an inner shaft limit baffle 22, and an inner shaft 23. The outer slideway 21 is fixed with the trolley top die-end die assembly 10, the inner shaft 23 is fixed with the trolley top die assembly 11, and the inner shaft limit baffle 22 is arranged on the outer slideway 21 to limit and fix the inner shaft 23. The trolley top die-end die assembly 10 is fixed with the outer slideway 21 of the trolley top die-end die fixing device (i.e., guide slot) 8, the trolley top die assembly 11 is fixed with the inner shaft 23 of the trolley top die-end die fixing device (i.e., guide slot) 8, and the outer slideway portion of the top die-end die fixing device (i.e., guide slot) 8 is matched with the inner shaft part with a fit clearance of 1 mm. At the same time, the trolley top die assembly 11 can be ensured not to be separated from the trolley top die-end die assembly 10.

The trolley top die-end die hydraulic telescopic device 9, structured as shown in FIG. 3, comprises a telescopic cylinder trolley end fixing lug 31, a telescopic cylinder 32, a trolley end fixing plate 33, and a telescopic cylinder end die end fixing lug 34. The trolley end fixing plate 33 is fixed on the trolley top die assembly 11, the telescopic cylinder trolley end fixing lug 31 is fixed with the trolley end fixing plate 33, the telescopic cylinder end die end fixing lug 34 is fixed with the trolley top die-end die assembly 10, and the telescopic cylinder trolley end fixing lug 31 is connected with the telescopic cylinder end die end fixing lug 34 by means of the telescopic cylinder 32. The telescopic cylinder 32 is controlled to make the trolley top die-end die assembly 10 reach a designated position.

The hydraulic control system 1 controls the trolley top die-end die hydraulic telescopic device 9 to drive the trolley top die-end die assembly 10 to stretch out and draw back to use positions, so that the trolley top die-end die assembly 10 can precisely stretch out and draw back with the hydraulic control system 1 as a force generation, the trolley top die-end die hydraulic telescopic device 9 as a force transmission point, and the top die-end die fixing device (i.e., guide slot) 8 as a guide point to reach precision control requirements.

The circumferential medium-buried water stop 5, structured as shown in FIG. 4, comprises a trolley hydraulic end die lower structure 41, a trolley hydraulic end die upper-lower structure connection hinge 42, and a trolley hydraulic end die upper structure 43. The trolley hydraulic end die lower structure 41 is fixed on the trolley top die assembly 11 by means of the trolley top die-end die fixing device (i.e., guide slot) 8, and the trolley hydraulic end die upper structure 43 is connected with the trolley hydraulic end die lower structure 41 by means of the trolley hydraulic end die upper-lower structure connection hinge 42. Before the circumferential medium-buried water stop 5 is mounted, the trolley hydraulic end die upper structure 43 is turned down by means of the trolley hydraulic end die upper-lower structure connection hinge 42, and then the trolley hydraulic end die upper structure 43 is turned up for fixing, thus ensuring the position of the water stop and keeping the water stop from being damaged easily.

Mounting and Dismounting Portion:

After the trolley top die-end die assembly 10 and the trolley side die-end die assembly 6 are mounted, the trolley top die-end die assembly 10 is connected with the trolley side die-end die assembly 6 as a whole by means of the trolley end die connection device 7, and then concrete is placed after the whole body is reinforced.

Figure 5:
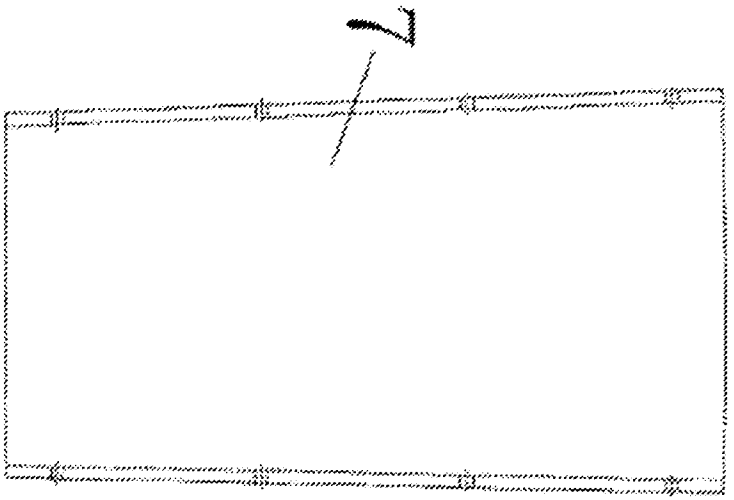
FIG. 5 illustrates a structure diagram of a trolley end die connection device.

The trolley end die connection device 7, structured as shown in FIG. 5, is an arc-shaped formwork with the same radius as that of the trolley, and formed by a 4 mm face plate and a 10 mm flange plate through processing; left and right flanges are provided with bolted connection holes, and butt jointed with flange plates of the trolley top die-end die assembly 10 and the trolley side die-end die assembly 6 respectively to achieve the effect of die sealing.

Before the trolley top die-end die assembly 10 and the trolley side die-end die assembly 6 are dismounted, the reinforcement portion should be dismounted. The trolley end die connection device 7 is dismounted so that the trolley top die-end die assembly 10 is separated from the trolley side die-end die assembly 6, and then the trolley top die-end die assembly 10 and the trolley side die-end die assembly 6 are sequentially dismounted.

The device is formed by cutting ordinary steel, and the control system is the original control system of the trolley. The advantages comprise easily available materials, simple control, and low cost. It can be convenient to use, and can be recycled to save resources.

The device is simply structured, conveniently and quickly operated and safely used. It effectively solves the key technical problem in tunnel secondary lining construction, and it is safer and more reliable and convenient than the previous method of a plank and a batten. The whole cycle process from trolley travel to secondary lining concrete placing can be completed without dismounting, thus reducing construction costs and improving labor productivity.

The invention claimed is:

1. A hydraulic end die of a tunnel secondary lining trolley, comprising:

a trolley side die-end die assembly and a trolley top die-end die assembly, wherein the trolley side die-end die assembly is fixed at an outer ring of a trolley side die assembly by means of a trolley side die-end die fixing device, the trolley top die-end die assembly is fixed at an outer ring of a trolley top die assembly by means of a trolley top die-end die fixing device, and the trolley side die-end die assembly and the trolley top die-end die assembly are connected with a hydraulic control system by means of a trolley side die-end die hydraulic telescopic device and a trolley top die-end die hydraulic telescopic device, wherein the trolley top die-end die assembly and the trolley side die-end die assembly are connected as a whole by means of a trolley end die connection device, and wherein the trolley end die connection device is a curved formwork having a same radius as that of the trolley, and comprises a 4 mm face plate and a 10 mm flange plate, and each of left and right flanges is provided with bolted connection holes, and are butt jointed with flange plates of the trolley top die-end die assembly and the trolley side die-end die assembly, respectively.

2. The hydraulic end die of a tunnel secondary lining trolley according to claim 1, wherein each of the trolley side die-end die fixing devices comprises an outer slideway, an inner shaft and an inner shaft limit baffle arranged on the outer slideway; and the outer slideway is affixed to the trolley side die-end die assembly, and the inner shaft is affixed to the trolley side die assembly.

3. The hydraulic end die of a tunnel secondary lining trolley according to claim 2, wherein a clearance between the outer slideway and the inner shaft is 1 mm.

4. The hydraulic end die of a tunnel secondary lining trolley according to claim 1, wherein the trolley side die-end die telescopic device comprises a trolley end fixing plate fixed on the trolley side die or top die assembly and a telescopic cylinder end die end fixing lug affixed to the trolley side die-end die assembly; a telescopic cylinder trolley end fixing lug is provided on the trolley end fixing plate, and the telescopic cylinder trolley end fixing lug is connected with the telescopic cylinder end die end fixing lug by means of a telescopic cylinder.

5. The hydraulic end die of a tunnel secondary lining trolley according to claim 4, wherein the telescopic cylinder trolley end fixing lug and the telescopic cylinder end die end fixing lug are connected together by means of a lug and a pin shaft.

6. The hydraulic end die of a tunnel secondary lining trolley according to claim 1, wherein the circumferential medium-buried water stops are provided on the trolley side die-end die assembly and the trolley top die-end die assembly, respectively.

7. The hydraulic end die of a tunnel secondary lining trolley according to claim 6, wherein the trolley circumferential medium-buried water stop comprises a trolley hydraulic end die lower structure and a trolley hydraulic end die upper structure hinged together by means of a trolley hydraulic end die upper-lower structure connection hinge, and the trolley hydraulic end die lower structure is affixed to the trolley side die-end die or the trolley top die-end die assembly by means of the trolley side die-end die or the trolley top die-end die fixing device.

8. The hydraulic end die of a tunnel secondary lining trolley according to claim 1, wherein the trolley top die-end die fixing devices comprises an outer slideway, an inner shaft and an inner shaft limit baffle arranged on the outer slideway; and the outer slideway is affixed to the trolley top die-end die assembly, and the inner shaft is affixed to the trolley top die assembly.

9. The hydraulic end die of a tunnel secondary lining trolley according to claim 1, wherein the trolley top die-end die hydraulic telescopic device comprises a trolley end fixing plate fixed on the trolley side die or top die assembly and a telescopic cylinder end die end fixing lug affixed to the trolley side die-end die assembly; a telescopic cylinder trolley end fixing lug is provided on the trolley end fixing plate, and the telescopic cylinder trolley end fixing lug is connected with the telescopic cylinder end die end fixing lug by means of a telescopic cylinder.

10. A construction method using the hydraulic end die of a tunnel secondary lining trolley of claim 1, comprising the following steps:

mounting the trolley top die-end die assembly and the trolley side die-end die assembly, respectively; turning down a trolley hydraulic end die upper structure by means of a trolley hydraulic end die upper-lower structure connection hinge, fixing a trolley hydraulic end die lower structure on the trolley top die or the trolley side die assembly by means of a top die or side die-end die fixing device, and turning up the trolley hydraulic end die upper structure for fixing to mount circumferential medium-buried water stops; using the hydraulic control system to control trolley side die and top die-end die hydraulic telescopic devices to drive the trolley side die and top die-end die assemblies to stretch out and draw back to use positions under the guidance of the end die fixing device; connecting the trolley top die-end die assembly and the trolley side die-end die assembly into a whole by means of a trolley end die connection device, and then placing concrete; and dismounting the reinforcement portion, then dismounting the trolley end die connection device to separate the trolley top die-end die assembly from the trolley side die-end die assembly, and sequentially dismounting the trolley top die-end die assembly and the side die-end die assembly.

* * * * *